US009388006B2

(12) United States Patent
Elkinson et al.

(10) Patent No.: US 9,388,006 B2
(45) **Date of Patent: *Jul. 12, 2016**

(54) COMPRESSIBLE NIP ROLLS FOR MULTIRIBBON TRANSPORT

(75) Inventors: Brian Robert Elkinson, Barrington, NH (US); Daniel Matthew Perdue, Rochester, NH (US); Lawrence Edward Zagar, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 1138 days.

This patent is subject to a terminal disclaimer.

(21) Appl. No.: 11/999,551

(22) Filed: Dec. 6, 2007

(65) Prior Publication Data

US 2008/0150208 A1 Jun. 26, 2008

Related U.S. Application Data

(62) Division of application No. 10/980,583, filed on Nov. 3, 2004.

(51) Int. Cl.

| | |
|---|---|
| ***B65H 29/12*** | (2006.01) |
| ***B65H 20/02*** | (2006.01) |
| ***B65H 45/22*** | (2006.01) |

(52) U.S. Cl.

CPC ..... *B65H 20/02* (2013.01); *B65H 29/12* (2013.01); *B65H 45/221* (2013.01); *B65H 2401/111* (2013.01); *B65H 2404/14* (2013.01); *B65H 2404/563* (2013.01)

(58) Field of Classification Search

CPC ..... B65H 20/02; B65H 29/12; B65H 45/221; B65H 2404/563; B65H 2401/111; B65H 2404/14

USPC ..... 101/375, 376, 227; 492/49, 56, 59

See application file for complete search history.

(56) References Cited

U.S. PATENT DOCUMENTS

| | | | | |
|---|---|---|---|---|
| 2,334,283 | A * | 11/1943 | Pfeiffer | 270/52.11 |
| 2,407,239 | A | 9/1946 | Albrecht | |
| 3,788,638 | A * | 1/1974 | Lehmann | 271/272 |
| 4,484,982 | A * | 11/1984 | Majaniemi | 162/358.3 |
| 4,493,690 | A | 1/1985 | Niemiro et al. | |
| 4,545,782 | A | 10/1985 | Niemiro et al. | |
| 4,707,408 | A | 11/1987 | Iwasawa et al. | |
| 5,213,317 | A | 5/1993 | Mandel et al. | |
| 5,273,515 | A | 12/1993 | Fenske | |

(Continued)

FOREIGN PATENT DOCUMENTS

| | | |
|---|---|---|
| DE | 43 15 456 | 11/1993 |
| EP | 0 191 590 | 8/1986 |

OTHER PUBLICATIONS

Helmut Kipphan (Ed.), Handbook of Print Media, 2001, pp. 270-272 ISBN 3-540-67326, Springer-Verlag Berlin Heidelberg, New York.

*Primary Examiner* — Jennifer Simmons

(74) *Attorney, Agent, or Firm* — Davidson, Davidson & Kappel, LLC

(57) ABSTRACT

A folder superstructure includes a former, a first nip roll located downstream of the former and having a compressible outer layer, and a second nip roll forming a nip with the first nip roll. A nip roll for nipping a plurality of superimposed printed ribbons or webs is also disclosed, the nip roll including a roll body and a compressible layer disposed about the roll body. A method for operating a printing press is also provided.

16 Claims, 4 Drawing Sheets

(56) References Cited

U.S. PATENT DOCUMENTS

| | | | | |
|---|---|---|---|---|
| 5,415,612 | A * | 5/1995 | Carlson et al. | 492/56 |
| 5,564,684 | A | 10/1996 | Salancy | |
| 5,728,252 | A | 3/1998 | Kniazzeh | |
| 5,904,094 | A * | 5/1999 | Bredenberg | 101/216 |
| 5,915,301 | A | 6/1999 | Pollock | |
| 6,338,707 | B1 * | 1/2002 | Michalik | 493/357 |
| 6,393,247 | B1 | 5/2002 | Chen et al. | |
| 6,443,064 | B1 * | 9/2002 | McEachern | 101/382.1 |
| 6,463,250 | B1 * | 10/2002 | Chen et al. | 399/330 |
| 6,556,798 | B2 * | 4/2003 | Rimai et al. | 399/167 |
| 6,588,739 | B1 * | 7/2003 | Weis | 270/6 |
| 2002/0063541 | A1 * | 5/2002 | Cote et al. | 318/432 |
| 2002/0165075 | A1 | 11/2002 | Shea et al. | |
| 2004/0132597 | A1 | 7/2004 | Sakakibara et al. | |

* cited by examiner

COMPRESSIBLE NIP ROLLS FOR MULTIRIBBON TRANSPORT

This application is a divisional of U.S. patent Ser. No. 10/980,583, filed Nov. 3, 2004, and which is hereby incorporated by reference herein.

BACKGROUND INFORMATION

The present invention relates to folder superstructures for web printing presses, to nip rolls used in multiribbon transport, as well as to a method for operating a printing press.

In a web printing press, a web or webs may be printed in various printing units. The webs then may enter a folder superstructure. There the webs may be slit into ribbons, which are then superimposed to form a ribbon bundle before passing to a former. The ribbon bundle in the folder superstructure may be drawn over a roller at the top of the former called an RTF by driven nip rolls located after the nose of the former. The ribbon bundle then may pass to folder where the ribbon bundle is cut into signatures.

The nip rolls may be spring-loaded against each other in an adjustable manner so as to set the pressure or "squeeze." Nip rolls with urethane or rubber outer layers are known. These rubber or urethane coatings are incompressible, as no air, microspheres or other gas inclusions are added to make them compressible.

A ribbon bundle may for example have six ribbons. The draw nip of the nip rolls can create uneven upstream longitudinal tensions of the different ribbons. A small change in nip pressure can also create large ribbon tension changes. To address uneven web tensions, gathering rolls or additional driven pull rolls upstream of the RTF are known.

BRIEF SUMMARY OF THE INVENTION

The present invention provides a folder superstructure comprising:

- a former;
- a first nip roll located downstream of the former and having a compressible outer layer; and
- a second nip roll forming a nip with the first nip roll.

The compressible outer layer advantageously has been found to reduce ribbon tension differences and also to create smaller tension changes in response to nip pressure alterations.

The present invention also provides a nip roll for nipping a plurality of superimposed printed ribbons or webs comprising a roll body and a compressible layer disposed about the roll body. The present invention also provides a nip roll for nipping a plurality of superimposed printed ribbons or webs comprising a roll body and a layer having a Poisson's ratio of 0.5 or less.

The present invention also includes a method for operating a printing press comprising:

- printing at least one web;
- forming a plurality of ribbons from the at least one web in a folder superstructure and superimposing the ribbons to form a ribbon bundle; and
- passing the ribbon bundle through nip rolls, at least one of the nip rolls having a compressible layer.

BRIEF DESCRIPTION OF THE DRAWINGS

The present invention will be further described with respect the following Figures, in which.

DETAILED DESCRIPTION OF A PREFERRED EMBODIMENT

Figure 1:
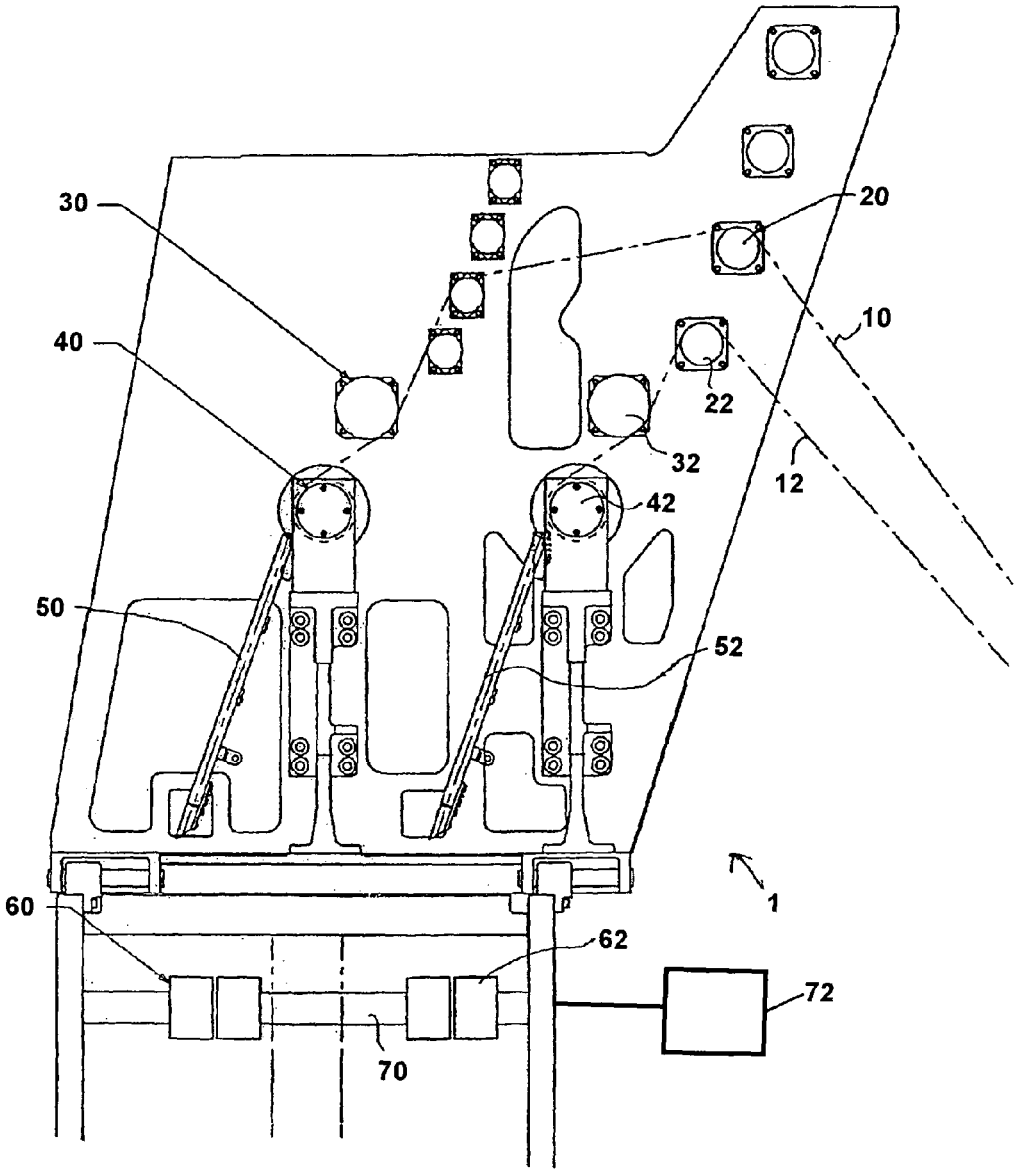
FIG. 1 shows schematically a profile view of a folder superstructure.

FIG. 1 shows a folder superstructure 1 in which ribbon bundles 10, 12 (shown partially and schematically) formed from printed webs pass over pull rolls 20, 22, then past gathering rolls 30, 32, to an RTF 40, 42, respectively. A rubber idler roll may push the ribbon bundle against the RTF, which may be driven.

A former 50, 52 may then impart a longitudinal fold to the ribbon bundle 10, 12 which is drawn over the former 50, 52 by driven nip rolls 60, 62, respectively. The driven nip rolls 60, 62 may have a common axle 70, and be driven by an independent phase-controlled motor 72, or alternately be driven by a mechanical connection to a main drive for the folder superstructure 1. The nip rolls 60, 62 are adjustable with respect to other nip rolls (see FIG. 2) to alter nip pressure, also known as squeeze.

Figure 2:
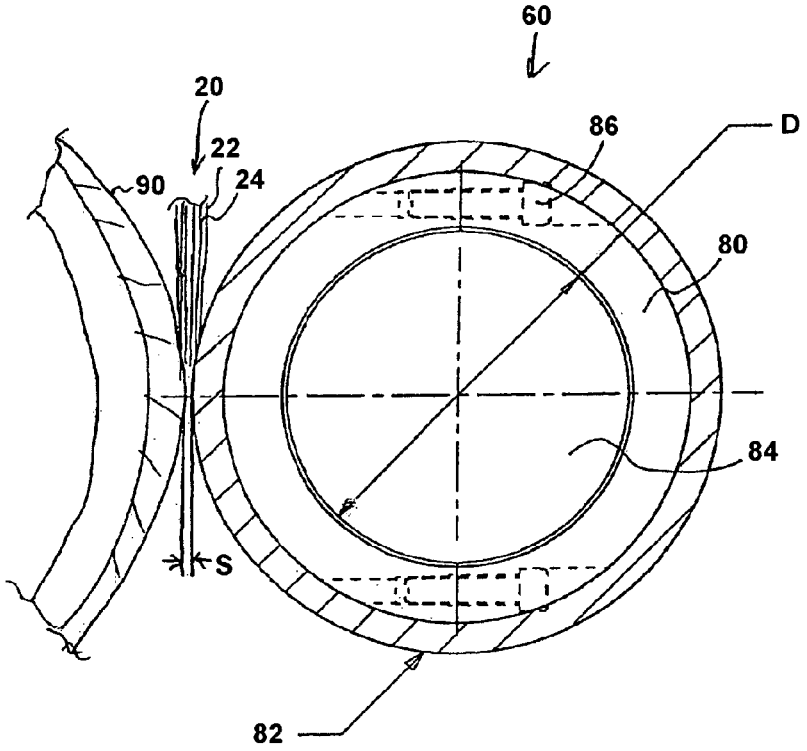
FIG. 2 shows a side view of a nip roll.

FIG. 2 shows nip roll 60, which has a body 80, made for example of steel, about which is a compressible outer layer 82 made of for example microcellular foamed urethane of 40 durometer with, for example, a Poisson's ratio of 0.35. Preferably, the Poisson's ratio for the outer layer, which may be made of foamed rubber, or any other suitable material, is 0.5 or less. Preferably, gas inclusions such as air are provided during manufacture of the nip roll. The body 80 for example may be placed in a mold and the urethane foamed around the outer surface of the body to form the outer layer 82. Body 80 may be hollow with an inner diameter 80, and may be fixed to axle 70 via screws or bolts 86

A second nip roll 90, which may be driven by motor 72 for example, is adjustable with respect to nip roll 60 to set the squeeze S. Second nip roll 90 preferably is similar in construction to nip roll 60. Nip roll 62 also has a corresponding second nip roll.

As ribbon bundle 20, for example with six ribbons, passes through the nip between rolls 60 and 90, the tension upstream from the nip varies between the ribbons. Thus for example an outermost ribbon 22 will have a different tension in the longitudinal direction than ribbon 24. Advantageously, it has been found that the use of the rolls with compressible outer layers according to the present invention can reduce the amount of tension difference between the ribbons in the bundle. Thus, the gathering rolls 30, 32 for example may not need to be adjusted as much or as far. Make-ready times and set-up can be reduced. Change in squeeze or pressure also does not result in as large ribbon-to-ribbon tension changes as with incompressible rolls, and thus pressure adjustments are simplified.

Figure 3:
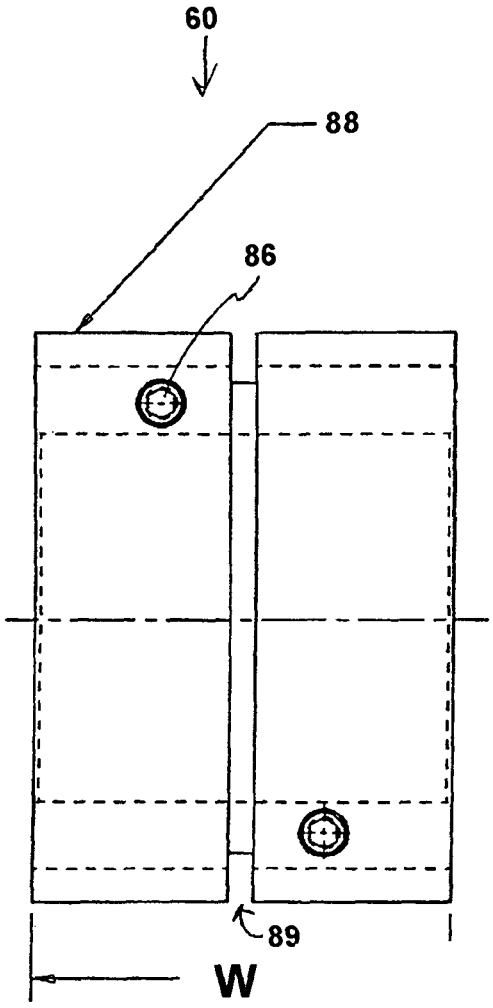
FIG. 3 shows a profile view of the nip roll of FIG. 2.

FIG. 3 shows roll 60 in profile. Outer surface 88 may be a continuous circumferential surface. However, a gap 89 along width W may be provided, as can holes for bolts or screws 86.

Although not preferable, an incompressible layer over the compressible layer may be provided in certain embodiments as long as the upstream ribbon-to-ribbon tension is still reduced.

Figure 4B:
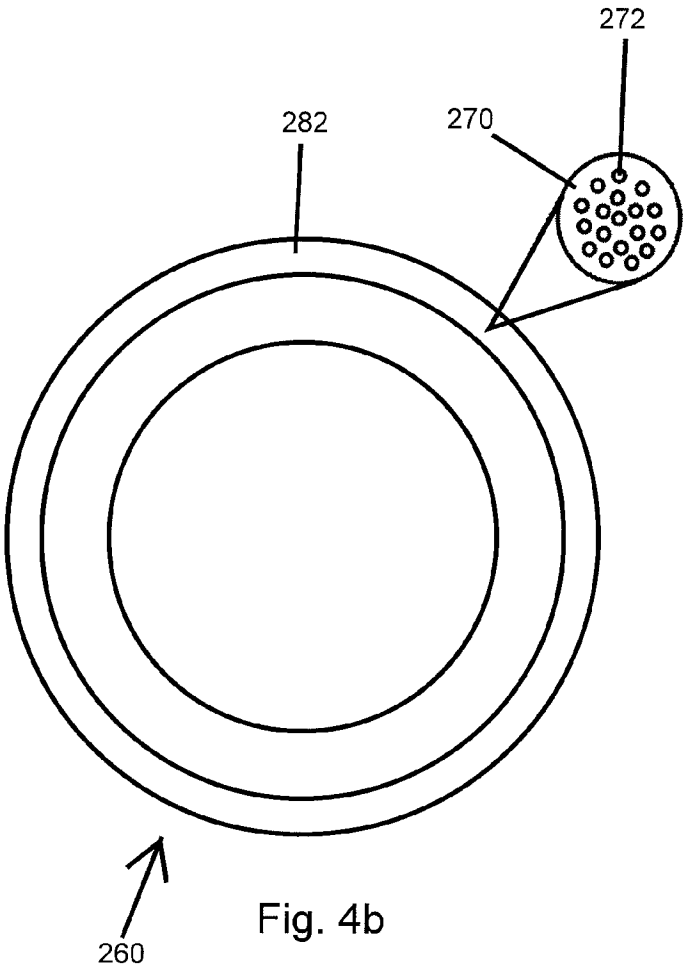
FIG. 4*b* schematically shows a nip roll having an outer compressible layer formed of a material having gas inclusions 272.
Figure 4A:
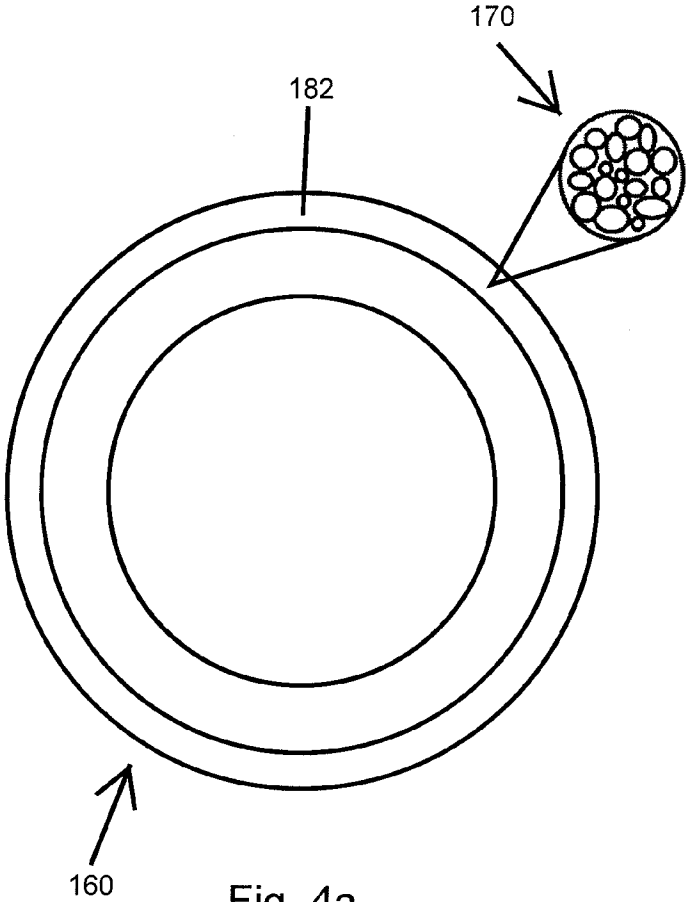
FIG. 4*a* schematically shows a nip roll having an outer compressible layer formed of a foamed material.

FIG. 4*a* schematically shows a nip roll 160 having an outer compressible layer 182 formed of a foamed material 170. Foamed material 170 may be foamed urethane or foamed rubber. FIG. 4*b* schematically shows a nip roll 260 having an outer compressible layer 282 formed of a material 270 having gas inclusions 272. Material 270 may be urethane or rubber.

What is claimed is:

1. A folder superstructure for a printing press comprising:

a former processing a plurality of superimposed printed ribbons or webs; and a first nip roll and a second nip roll forming a nip and nipping the plurality of superimposed printed ribbons or webs received from the former, the first and second nip rolls each including a roll body and a compressible layer disposed about the roll body.

2. The folder superstructure as recited in claim 1 wherein the compressible layer is made of a foamed material.

3. The folder superstructure as recited in claim 1 wherein the compressible layer has a Poisson's ratio of 0.50 or less.

4. The folder superstructure as recited in claim 1 wherein the compressible layer is made of urethane with gas inclusions.

5. The folder superstructure as recited in claim 1 wherein the compressible layer is made of rubber with gas inclusions.

6. The folder superstructure as recited in claim 1 wherein the first nip roll and the second nip roll draw the plurality of superimposed ribbons or webs over the former.

7. The folder superstructure as recited in claim 1 further comprising a motor driving the first nip roll and second nip roll.

8. The folder superstructure as recited in claim 7 wherein the motor is an independent phase-controlled motor.

9. The folder superstructure as recited in claim 1 wherein the first nip roll includes a hollow body fixed to an axle via screws or bolts.

10. The folder superstructure as recited in claim 9 further comprising a motor driving the axle.

11. The folder superstructure as recited in claim 1 further comprising:

a second former processing a second plurality of superimposed printed ribbons or webs; and a second former first nip roll and a second former second nip roll forming a second nip and nipping the second plurality of superimposed printed ribbons or webs received from the second former, the second former first and second former second nip rolls each including a second roll body and a second compressible layer disposed about the second roll body.

12. The folder superstructure as recited in claim 11 further comprising a common axle, the first nip roll and second former nip roll each being connected on the common axle.

13. The folder superstructure as recited in claim 12 further comprising a motor driving the common axle.

14. The folder superstructure as recited in claim 13 wherein the motor is an independent phase-controlled motor.

15. The folder superstructure as recited in claim 12 wherein the first nip roll includes a hollow body fixed to the common axle via screws or bolts.

16. A folder superstructure for a printing press comprising:

an RTF receiving a plurality of superimposed printed ribbons or webs;

a former contacting the plurality of superimposed printed ribbons or webs; and a first nip roll and a second nip roll forming a nip and nipping the plurality of superimposed printed ribbons or webs received from the former, the first and second nip rolls each including a roll body and a compressible layer disposed about the roll body.

* * * * *